US010276330B2

(12) United States Patent
Yang et al.

(10) Patent No.: US 10,276,330 B2
(45) Date of Patent: Apr. 30, 2019

(54) OPERATING MECHANISM OF CIRCUIT BREAKER

(71) Applicant: ZHEJIANG CHINT ELECTRICS CO., LTD., Zhejiang (CN)

(72) Inventors: Feng Yang, Zhejiang (CN); Yukun Jiang, Zhejiang (CN); Yingge Si, Zhejiang (CN)

(73) Assignee: ZHEJIANG CHINT ELECTRICS CO., LTD (CN)

( * ) Notice: Subject to any disclaimer, the term of this patent is extended or adjusted under 35 U.S.C. 154(b) by 0 days.

(21) Appl. No.: 15/506,933

(22) PCT Filed: Jan. 28, 2015

(86) PCT No.: PCT/CN2015/071737

§ 371 (c)(1),
(2) Date: Feb. 27, 2017

(87) PCT Pub. No.: WO2016/029645

PCT Pub. Date: Mar. 3, 2016

(65) Prior Publication Data

US 2017/0256372 A1 Sep. 7, 2017

(30) Foreign Application Priority Data

Aug. 27, 2014 (CN) ..... 2014 2 0487521 U

(51) Int. Cl.
*H01H 21/30* (2006.01)
*H01H 71/16* (2006.01)
(Continued)

(52) U.S. Cl.
CPC ..... *H01H 21/30* (2013.01); *H01H 71/16* (2013.01); *H01H 71/24* (2013.01); *H01H 71/526* (2013.01); *H01H 2235/01* (2013.01)

(58) Field of Classification Search
CPC ..... H01H 21/30; H01H 71/16; H01H 71/24; H01H 2235/01
(Continued)

(56) References Cited

U.S. PATENT DOCUMENTS 4,725,799 A * 2/1988 Bratkowski ..... H01H 89/08 335/14
4,829,147 A 5/1989 Schiefen et al. ..... 200/17 R
(Continued)

FOREIGN PATENT DOCUMENTS

CN 202196721 4/2012
CN 202196721 U 4/2012
(Continued)

OTHER PUBLICATIONS

CN202196721, Yang et al., Apr. 2012, machine translation.*
(Continued)

*Primary Examiner* — Kyung S Lee
(74) *Attorney, Agent, or Firm* — Ostrolenk Faber LLP

(57) ABSTRACT

An operating mechanism of a circuit breaker comprising a static contact, a movable contact provided on a contact support and an operating handle that is in linkage with the contact support; a rotation shaft of the movable contact is concentric with a rotation shaft of the contact support, and the movable contact and the contact support are fixedly connected via an elastic component; the movable contact is capable of rotating relative to the contact support. The operating mechanism improves the response velocity of the movable contact.

10 Claims, 5 Drawing Sheets

Fig. 3

(51) Int. Cl.
*H01H 71/24* (2006.01)
*H01H 71/52* (2006.01)

(58) Field of Classification Search
USPC ..... 200/335; 335/14, 16
See application file for complete search history.

(56) References Cited

U.S. PATENT DOCUMENTS 5,479,143 A * 12/1995 Payet-Burin ..... H01H 71/0228 335/16
7,528,690 B2 * 5/2009 Christmann ..... H01H 71/526 335/2
7,839,241 B2 * 11/2010 Weber ..... H01H 71/526 335/35
2007/0046403 A1 * 3/2007 Christmann ..... H01H 71/526 335/35
2009/0015359 A1 * 1/2009 Spitsberg ..... H01H 71/24 335/166
2014/0354380 A1 * 12/2014 Fasano ..... H01H 71/2463 335/1
2016/0163482 A1 * 6/2016 Maloney ..... H01H 33/08 218/149

FOREIGN PATENT DOCUMENTS

CN 204118012 U 1/2015
EP 0570647 11/1993
WO WO 2009082358 A1 * 7/2009 ..... H01H 71/1081

OTHER PUBLICATIONS

International Search Report dated Jun. 5, 2015 in corresponding PCT International Application No. PCT/CN2015/071737.
Written Opinion dated Jun. 5, 2015 in corresponding PCT International Application No. PCT/CN2015/071737.
Colombian Office Action dated Jun. 25, 2018 issued in corresponding Colombian Patent Application No. NC2017/0002920.

* cited by examiner

OPERATING MECHANISM OF CIRCUIT BREAKER

CROSS-REFERENCE TO RELATED APPLICATIONS

The present application is a 35 U.S.C. §§ 371 national phase conversion of PCT/CN2015/071737, filed Jan. 28, 2015, which claims priority to Chinese Patent Application No. 201420487521.X, filed Aug. 27, 2014, the contents of which are incorporated herein by reference. The PCT International Application was published in the Chinese language.

TECHNICAL FIELD

The utility model relates to the field of power distribution, in particular to an operating mechanism of a circuit breaker.

BACKGROUND ART

An operating mechanism of an existing circuit breaker comprises a handle connected with a transmission link to constitute a toggle; a movable contact support device having a plate rotatably mounted on a pivot; and a mechanical interlock that may be disconnected by means of the action of a tripping rod. Such interlock is formed by cooperating a stop catch of the tripping rod with a lock latch rotatably mounted on a mandrel of the plate. A connecting stick is directly connected to the lock latch, and such assembly constitutes a speed-reduction transmission stage which is able to reduce a tripping force; a bimetallic strip is connected to the tripping rod via a unidirectionally driven rotation connecting stick. The existing small-sized circuit breaker mechanism has a smaller releasing force and easily obtains favorable relief pressure, but the movement velocity of a movable contact thereof is low to affect the performances of the circuit breaker.

SUMMARY OF THE INVENTION

An objective of the present utility model is to provide an operating mechanism of a circuit breaker, which can improve the response velocity of a movable contact, to overcome the defects of the prior art.

In order to achieve said objective, the present utility model adopts the following technical solutions:

an operating mechanism of a circuit breaker comprises: a static contact, a movable contact provided on a contact support and an operating handle that is in linkage with the contact support; a rotation shaft of the movable contact is in concentric with a rotation shaft of the contact support, and the movable contact and the contact support are fixedly connected via an elastic component; the movable contact is capable of rotating relative to the contact support.

Further, a conductive contact point matched with the static contact is provided at one end of the movable contact; a rotation hole is formed in the other end of the movable contact. The contact support is provided with a cylindrical lug boss at a rotation axis thereof, and the rotation hole is in sleeve joint to the lug boss. The elastic component comprises a releasing spring which is in sleeve joint to the lug boss, and two ends of the releasing spring are fixed onto the contact support and the movable contact respectively. The releasing spring is adopted as the elastic component and the contact support, the releasing spring and the movable contact are located coaxially, thereby reducing the occupied space; in addition, by means of the location with the lug boss, the releasing spring can be effectively fixed, such that the elastic stress acts stably along a tangential direction of the lug boss to ensure that the movable contact can be released stably and reliably.

Further, the edge, away from the movable contact point, of the rotation hole is provided with a raised column body, and a spring slot which is in contact and fixed with the releasing spring is provided at one side of the column body. This is a specific releasing spring fixing structure, i.e., the column body may not only be considered as a limiting structure for the movable contact, but also be considered as a locating structure for the releasing spring, and is thus low in implementation cost and beneficial to reduction of an occupied space.

Further, the movable contact comprises a disc which is hollowed at an axis thereof to form the rotation hole; a trigger lever extends from the edge of the disc, and the movable contact point is formed at the end portion of the trigger lever; the edge, away from the trigger lever, of the disc is provided with the column body, a bump is provided at one side of the top of the column body, and the spring slot is formed in one side, corresponding to the column body, of the bump; a limiting surface is formed at the other side of the column body; the trigger lever and the disc are fixed on the same plane; the column body and the disc are fixed vertically. This is a specific movable contact shape which is convenient for rotating and limiting by means of its disc-shaped structure. Further, the contact support is provided with a ring slot, where the disc of the movable contact is placed, around the rotation shaft; a first notch and a second notch are provided at positions, avoiding the column body and the trigger lever, of the ring slot respectively; a locating surface is provided at one end, opposite to the limiting surface, of the first notch; a spring pillar is provided at a position, adjoining to the locating surface, on the edge of the ring slot; a fixing slot which is recessed inwardly, penetrates through a part of the slot wall of the ring slot and is used for fixing the end portion of the releasing spring is provided in one side, departing from the locating surface, of the spring pillar. Further, a clamping slot which penetrates through the slot wall of the ring slot is provided at the bottom of the second notch in a releasing rotation direction of the trigger lever; a limiting portion for preventing the trigger lever from dropping along the axial direction is formed at the slot wall portion of the ring slot at the top of the clamping slot; the movable contact is capable of rotating inside a space defined by the first notch and the second notch relative to the contact support. Further, an inclined introduction surface is provided at one end, facing to the fixing slot, on the top of the spring pillar; a supporting plate for supporting the trigger lever is formed by extending outwards from a position, where the second notch is placed, at the bottom of the ring slot. The disc of the movable contact is located by adopting the ring slot, such that the movable contact is capable of rotating stably relative to the contact support, and the two notches are capable of limiting the rotation position of the movable contact on the contact support from two ends of the disc, and therefore the limiting effect is better; and in addition, the impact force when the movable contact collides with the contact support may be averagely distributed by limiting with the two notches, the impact loss is reduced, and the service life of the product is prolonged.

Further, the contact support further comprises a mechanical interlocking rotation shaft and a lock catch rotation shaft; the operating mechanism further comprises a transmission link, a mechanical interlocking device, a lock catch, and a releasing device matched with the lock catch to realize a releasing action of the circuit breaker; the mechanical interlocking device and the lock catch are pivotally provided on the mechanical interlocking rotation shaft and the lock catch rotation shaft of the contact support respectively; one end of the mechanical interlocking device is in hinged connection to the operating handle through the transmission link; the other end of the mechanical interlocking device is connected with a hasp of the lock catch. The mechanical interlocking device and the lock catch are provided on the contact support; it is unnecessary to additionally provide a rotating plate, such that the fixing structure is simplified, and the reliability of the product is improved favorably.

Further, the releasing device comprises an electromagnetic releasing module which comprises a striker, wherein the striker is in contact and fixed with a movable iron core of the electromagnetic releasing module under the extrusion of an acting spring, and the striker can be popped up to strike the lock catch, such that the mechanical interlocking device is separated from the hasp of the lock catch. The existing striker is connected with the movable iron core of the electromagnetic tripping module in a manner of close fit of axial holes, and requires certain firmness, or will be cause failure of the releasing function in case of loose joint. In this technical solution, the striker is in contact with a movable iron core of the electromagnetic releasing module under the extrusion of the releasing spring, rather than being fixed, and therefore the reliability of the product is improved.

Further, the releasing device comprises a thermal overload releasing module, wherein the thermal overload releasing module comprises a bimetallic strip that is deformable according to the temperature change. A releasing link is provided on the lock catch. The bimetallic strip is fixedly connected with the releasing link, such that the mechanical interlocking device is separated from the hasp of the lock catch.

The movable contact and the contact support of the present utility model adopt the same rotation axis, such that the force arm is reduced to be minimum, and therefore, when the contact support acts, the movable contact can respond the action quickly, and the response velocity is improved remarkably compared to that of the prior art. The elastic component can be adopted to realize fixed connection, and the movable contact is capable of rotating relative to the contact support, such that the impact force when the movable contact contacts the contact support and the static contact can be buffered, and the releasing force is reduced and the service life of the product is prolonged while the response velocity is improved; in addition, a gluing procedure is canceled from the contacts and the contact support, and therefore the reliability of the product is improved.

Figure 1:
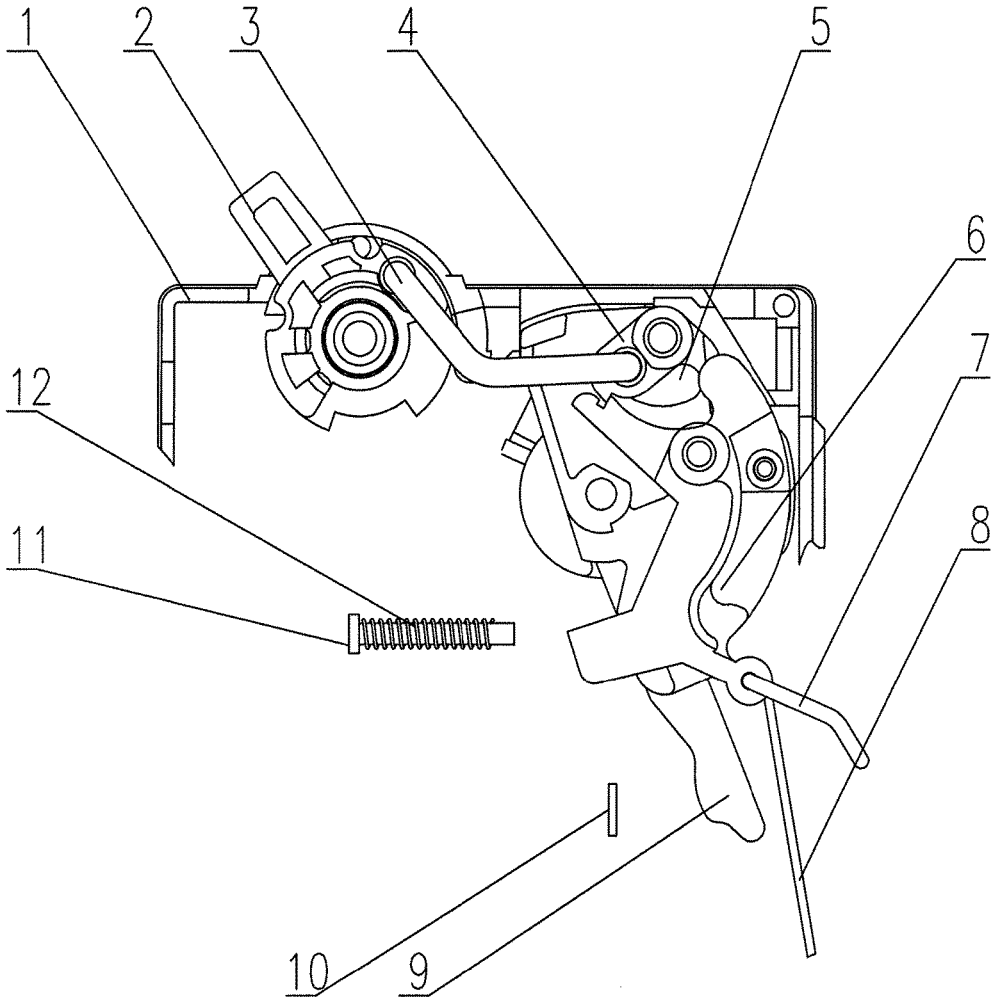
FIG. 1 is a structural schematic diagram where the operating mechanism of the circuit breaker of the present utility model is in a switched-off state.

where the shell 1, the operating handle 2, the transmission link 3, the mechanical interlocking device 4, the contact support 5, the ring slot 511, the first notch 512, the second notch 513, the introduction surface 50, the lug boss 51, the spring pillar 52, the locating surface 53, the mechanical interlocking rotation shaft 54, the fixing slot 55, the lock catch rotation shaft 56, the clamping slot 57, the supporting plate 58, the limiting portion 59, the lock catch 6, the releasing link 7, the bimetallic strip 8, the movable contact 9, the rotation hole 91, the spring slot 92, the limiting surface 93, the disc 94, the trigger lever 95, the column body 96, the static contact 10, the striker 11, the acting spring 12 and the releasing spring 13 are illustrated.

DETAILED DESCRIPTION OF THE PREFERRED EMBODIMENTS

The present utility model discloses a circuit breaker. The circuit breaker comprises an operating mechanism. The operating mechanism comprises: a static contact, a movable contact provided on a contact support and an operating handle that is in linkage with the contact support; a rotation shaft of the movable contact is concentric with a rotation shaft of the contact support, and the movable contact and the contact support are fixedly connected via an elastic component; the movable contact is capable of rotating relative to the contact support. The elastic component may be made by selecting the following materials, such as a spring, a torsional spring and rubber.

Upon study, the rotation shafts of the existing movable contact and the existing contact support are independent from each other, but the rotation axes thereof are separated, thereby resulting in long rotation arm of the movable contact and low movement velocity of the mechanism. The rotation shafts of the movable contact and the contact support of the present utility model are concentric, such that the force arm is reduced to be minimum, and therefore, when the contact support acts, the movable contact can respond the action quickly, and the response velocity is improved remarkably compared to that of the prior art. The elastic component can be adopted to realize fixed connection, and the movable contact is capable of rotating relative to the contact support, such that the impact force when the movable contact contacts the contact support and the static contact can be buffered, the releasing forces is reduced and the service life of the product is prolonged while the response velocity is improved; in addition, a gluing procedure is canceled from the contacts and the contact support, and therefore the reliability of the product is improved.

Figure 2:
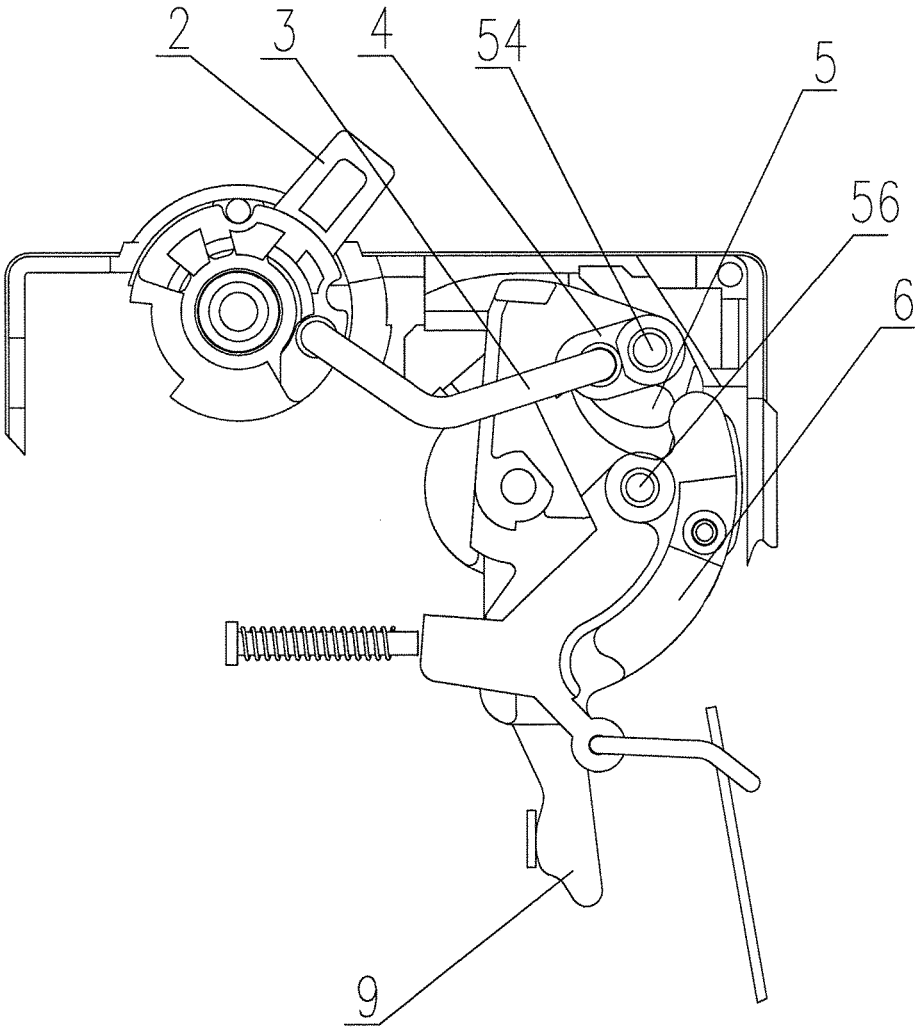
FIG. 2 is a structural schematic diagram where the operating mechanism of the circuit breaker of the present utility model is in a switched-on state.
Figure 3:
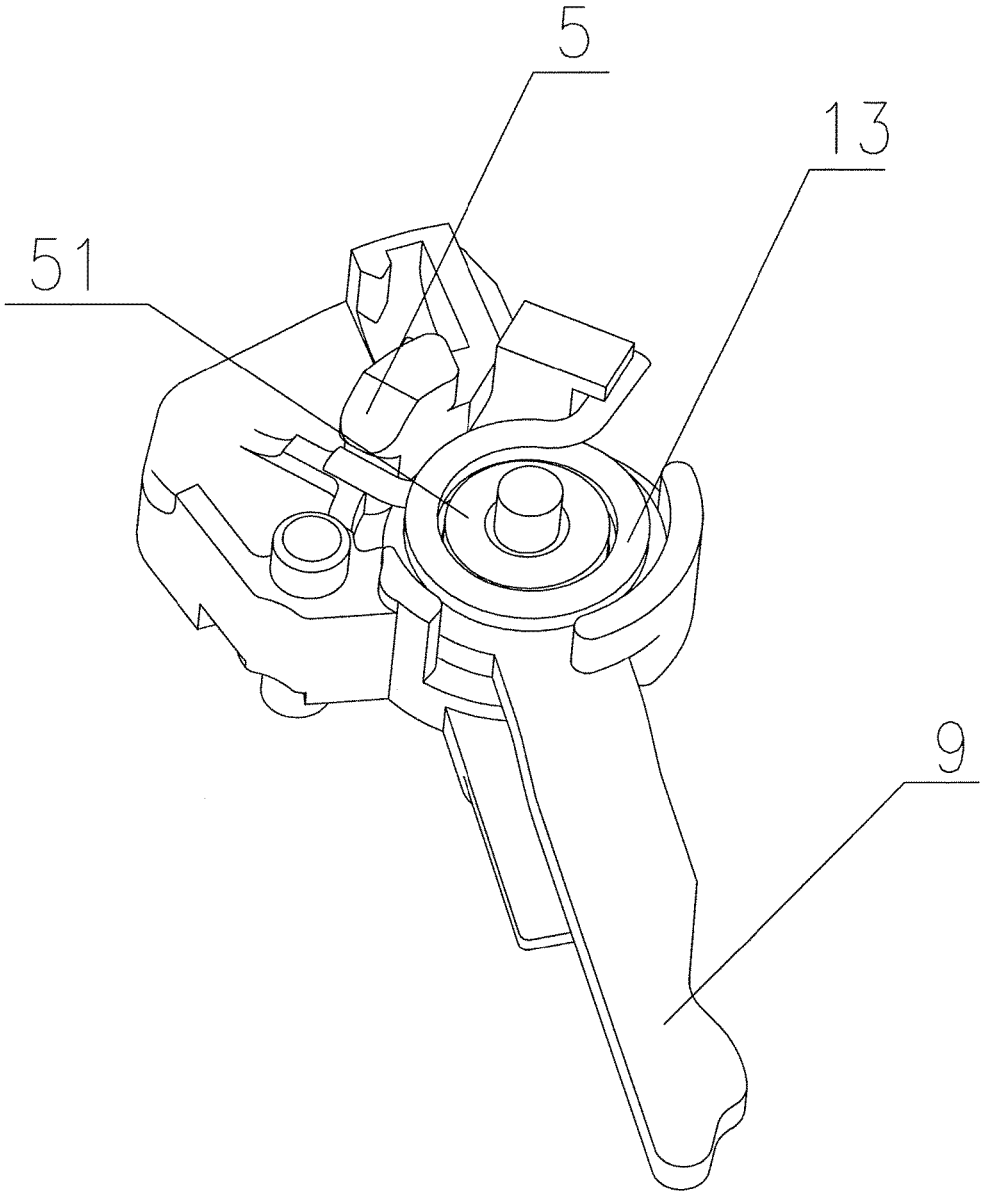
FIG. 3 is a structural schematic diagram where the movable contact is matched with the contact support of the circuit breaker of the present utility model.
Figure 4:
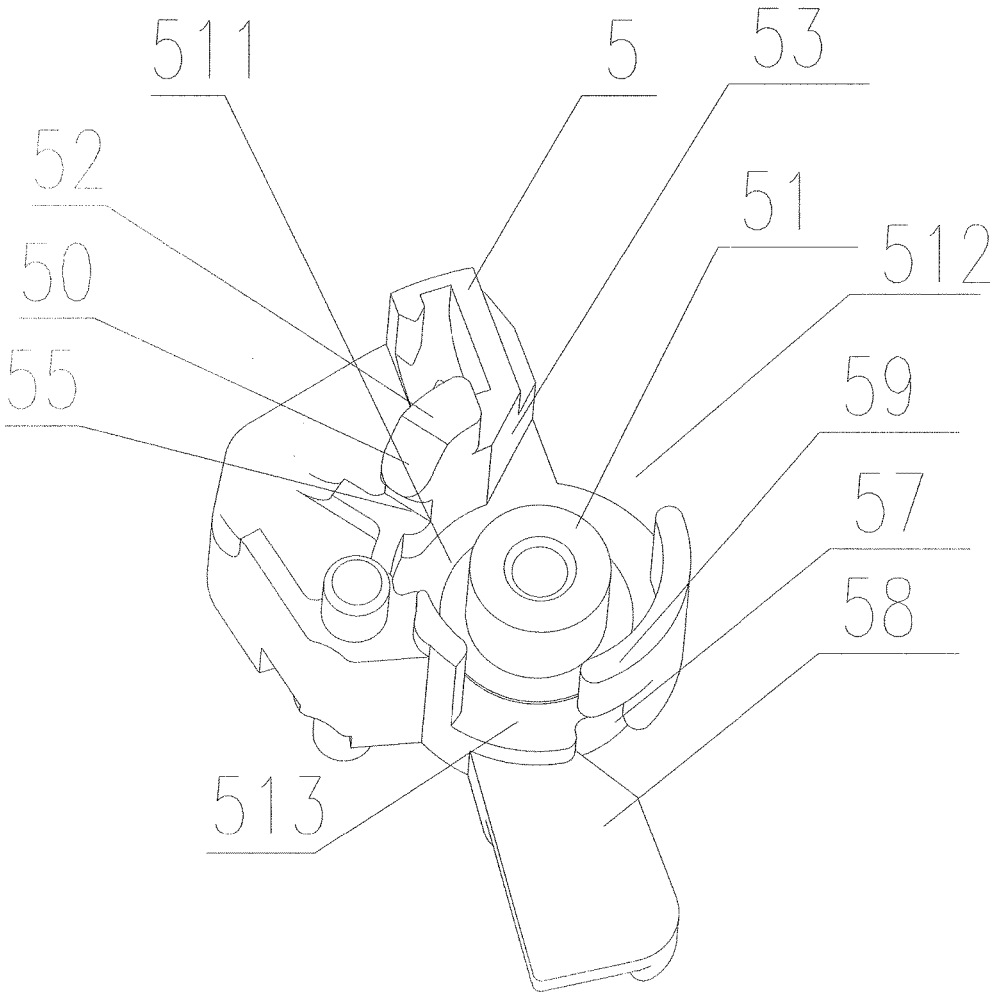
FIG. 4 is a structural schematic diagram of the contact support of the circuit breaker of the present utility model.
Figure 5:
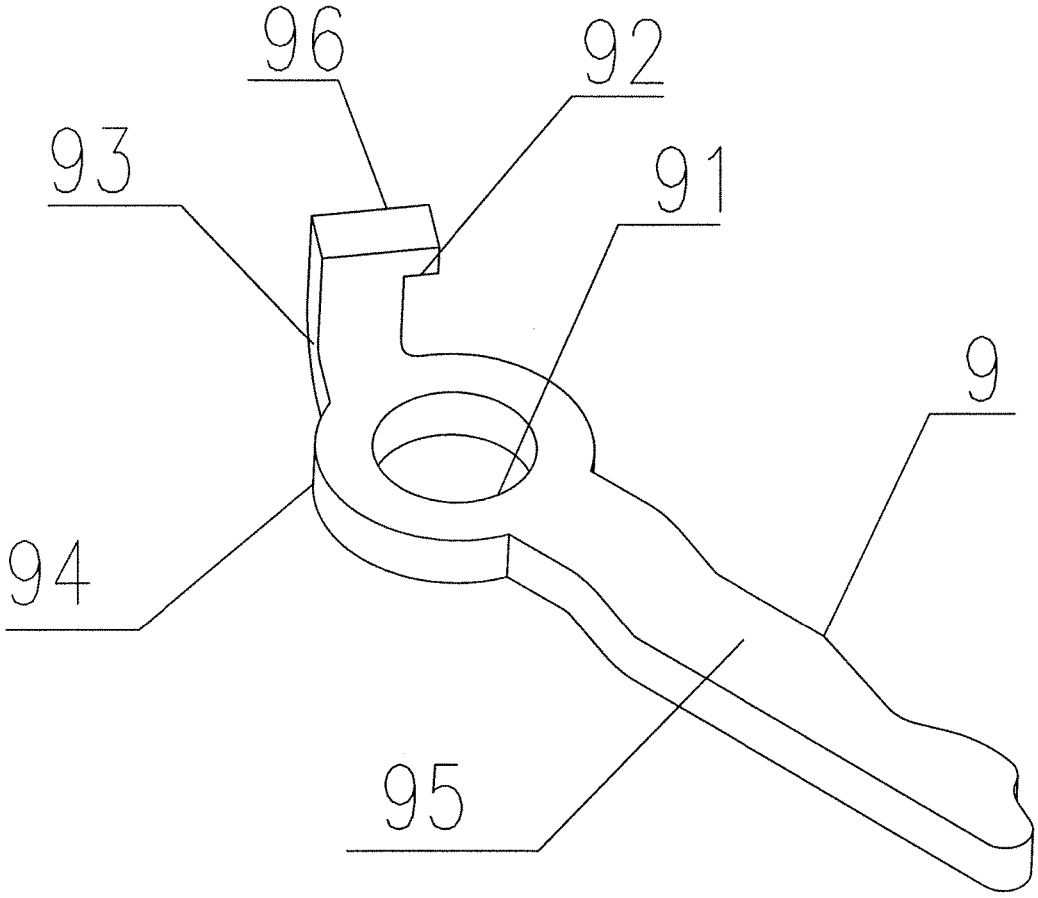
FIG. 5 is a structural schematic diagram of the movable contact of the circuit breaker of the present utility model.

The specific embodiments of the operating mechanism of the present utility model are further illustrated as below in conjunction with the embodiments provided by FIG. 1 to FIG. 5. The operating structure of the present utility model is not limited to the description of the following embodiments.

As illustrated in FIG. 1 to FIG. 5, an operating mechanism of a circuit breaker in this embodiment comprises: a static contact 10, a movable contact 9, a contact support 5 that is in linkage with the movable contact 9, and an operating handle 2 that is in linkage with the contact support 5; the movable contact 9 and the contact support 5 are provided on the same rotation shaft in a sleeving manner, and the movable contact 9 and the contact support 5 are fixedly connected via a releasing spring 13.

The operating mechanism is fixed inside a shell 1 of the circuit breaker and further comprises a transmission link 3, a mechanical interlocking device 4, a lock catch 6, and a releasing device which is matched with the lock catch to realize a releasing action of the circuit breaker; the contact support further comprises a mechanical interlocking rotation shaft 54 and a lock catch rotation shaft 56; the mechanical interlocking device and the lock catch are pivotally provided on the mechanical interlocking rotation shaft 54 and the lock catch rotation shaft 56 of the contact support 56 respectively; one end of the mechanical interlocking device 4 is in hinged connection to the operating handle 2 through the transmission link 3; the other end of the mechanical interlocking device 4 is connected with a hasp of the lock catch 6. A return spring for shifting the handle back to an off position is provided inside a rotation shaft of the operating handle 2 in a sleeving manner. The mechanical interlocking device 4 and the lock catch 6 are provided on the contact support 5; it is unnecessary to additionally provide a rotating plate, such that the fixing structure is simplified, and the reliability of the product is improved favorably.

The releasing device comprises an electromagnetic releasing module and an thermal overload releasing module, wherein the electromagnetic releasing module comprises a striker 11 which in contact and fixed with a movable iron core of the electromagnetic releasing module under the extrusion of an acting spring 12; the striker can be popped up to strike the lock catch such that the mechanical interlocking device is separated from the hasp of the lock catch. The striker 11 is in contact with a movable iron core of the electromagnetic releasing module under the extrusion of the releasing spring 13, rather than being fixed, and therefore the reliability of the product is improved.

The thermal overload releasing module comprises a bimetallic strip 8 that is deformable according to the temperature change. A releasing link 7 is provided on the lock catch 6. The bimetallic strip 8 is fixedly connected with the releasing link 7, such that the mechanical interlocking device is separated from the hasp of the lock catch.

The movable contact 9 comprises a disc 94 which is hollowed at an axis thereof to form a rotation hole 91; a trigger lever extends from the edge of the disc 94, and a conductive movable contact point matched with the static contact 10 is formed at the end portion of the trigger lever; the rotation hole 91 is in sleeve joint to the lug boss 51, a column body 96 is provided on the edge, away from the trigger lever, of the disc 94, a bump is provided at one side of the top of the column body 96, and a spring slot 92 is formed at one side, corresponding to the column body 96, of the bump; a limiting surface 93 is formed at the other side of the column body 96; the trigger lever and the disc 94 are fixed on the same plane; the column body 96 and the disc 94 are fixed vertically; the elastic component comprising a releasing spring 13 that is in sleeve joint to the lug boss 51.

The contact support 5 is provided with the cylindrical lug boss 51 at a rotation axis thereof, the contact support is mounted on the rotation shaft of the shell, and the movable contact is provided on the lug boss 51 of the contact support in a sleeving manner. The contact support is provided with a ring slot 511 where the disc 94 of the movable contact is placed, around the rotation shaft; a first notch 512 and a second notch 513 are provided at positions, avoiding the column body 96 and the trigger lever, of the ring slot 511 respectively; a locating surface 53 is provided at one end, opposite to the limiting surface, of the first notch; a spring pillar 52 is provided at a position, adjoining to the locating surface, on the edge of the ring slot; a fixing slot 55 which is recessed inwardly, penetrates through a part of the slot wall of the ring slot and is used for fixing the end portion of the releasing spring is provided in one side, departing from the locating surface, of the spring pillar. an inclined introduction surface 50 is provided at one end, facing to the fixing slot, on the top of the spring pillar; a supporting plate 58 for supporting the trigger lever is formed by extending outwards from a position, where the second notch is located, at the bottom of the ring slot; a clamping slot 57 which penetrates through the slot wall of the ring slot is provided at the bottom of the second notch in a releasing rotation direction of the trigger lever; a limiting portion 59 for preventing the trigger lever from dropping along the axial direction is formed at the slot wall portion of the ring slot at the top of the clamping slot; the movable contact is capable of rotating inside a space defined by the first notch and the second notch relative to the contact support; one end of the releasing spring is embedded into the spring slot 92; the other end of the releasing spring is embedded into the fixing slot 55.

In this embodiment, the releasing spring 13 is adopted as the elastic component and the contact support 5, the releasing spring 13 and the movable contact 9 are located coaxially, thereby reducing the occupied space; in addition, by means of the location with the lug boss 51, the releasing spring 13 can be effectively fixed, such that the elastic stress acts stably along a tangential direction of the lug boss 51 to ensure that the movable contact 9 can be released stably and reliably. The column body 96 may not only be considered as a limiting structure for the movable contact 9, but also be considered as a locating structure for the releasing spring 13, and is thus in low in implementation cost and beneficial to reduction of an occupied space.

The working principle of the present utility model is as follows:

normal switched-on and switched-off actions: the operating handle 2 rotates clockwise, the contact support 5 drives the common rotation shaft with the movable contact 9 to rotate clockwise through the transmission link 3, the mechanical interlocking device 4 and the lock catch 6, and is in contact with the static contact 10, and the operation mechanism reaches a closing position;

an off position corresponds to the separation of the movable contact 9 from the static contact 10, the handle turns to the off position anticlockwise under the action of a return spring (not shown), the static contact 10 is firmly connected to the electromagnetic releasing module, and only the striker 11 and the acting spring 12 of the electromagnetic releasing module are illustrated in drawings.

The principle under which the operating mechanism is switched off by the releasing device: the structure where the lock catch 6 is connected with the hasp of the mechanical interlocking device 4 may be separated; when an electromagnetic releasing or thermal releasing condition is reached in a circuit, a striker 11 of the electromagnetic releasing module popped up to strike the lock catch 6, while the thermal releasing module refers that the bimetallic strip 8 is bent to pull the lock catch 6 through the releasing link 7, such that the lock catch 6 is separated from the hasp surface of the mechanical interlocking device 4; the operating mechanism is automatically switched off, the handle turns to the off position under the action of the return spring, and the mechanism can make the movable contact 9 be separated from the static contact 10 quickly under the action of an energy storage spring (not shown).

The above content is the further detailed description made to the present utility model in conjunction with the specific preferred embodiments, but it will not believed that the specific implements of the present utility model are only limited to these descriptions. For those common skilled in the art to which the present utility model belongs, several simple deductions or replacements may also be made without departing from the concept of the present utility model, all of which should be considered to fall into the protection scope of the present utility model.

The invention claimed is:

1. An operating mechanism of a circuit breaker, comprising: a static contact, a movable contact provided on a contact support and an operating handle that is in linkage with the contact support, wherein a rotation shaft of the movable contact is concentric with a rotation shaft of the contact support, and the movable contact and the contact support are fixedly connected via an elastic component; and wherein the movable contact is capable of rotating relative to the contact support.

2. The operating mechanism of the circuit breaker according to claim 1, wherein a conductive contact point matched with the static contact is provided at one end of the movable contact; a rotation hole is formed in the other end of the movable contact; the contact support is provided with a cylindrical lug boss at a rotation axis thereof, and the rotation hole is in sleeve joint to the lug boss; the elastic component comprises a releasing spring which is in sleeve joint to the lug boss, and two ends of the releasing spring are fixed onto the contact support and the movable contact respectively.

3. The operating mechanism of the circuit breaker according to claim 2, wherein an edge, opposite the movable contact point, of the rotation hole is provided with a raised column body, and a spring slot which is in contact and fixed with the releasing spring is provided at one side of the column body.

4. The operating mechanism of the circuit breaker according to claim 3, wherein the movable contact comprises a disc which is hollowed at an axis thereof to form the rotation hole; a trigger lever extends from the edge of the disc, and the movable contact point is formed at the end portion of the trigger lever; the edge, away from the trigger lever, of the disc is provided with the column body, a bump is provided at one side of the top of the column body, and the spring slot is formed in one side, corresponding to the column body, of the bump; a limiting surface is formed at the other side of the column body; the trigger lever and the disc are fixed on the same plane; the column body and the disc are fixed vertically.

5. The operating mechanism of the circuit breaker according to claim 4, wherein the contact support is provided with a ring slot where the disc of the movable contact is placed, around the rotation shaft; a first notch and a second notch are provided at positions, avoiding the column body and the trigger lever, of the ring slot respectively; a locating surface is provided at one end, opposite to the limiting surface, of the first notch; a spring pillar is provided at a position, adjoining to the locating surface, on the edge of the ring slot; and a fixing slot which is recessed inwardly, and penetrates through a part of the slot wall of the ring slot and is used for fixing the end portion of the releasing spring is provided in one side, departing from the locating surface, of the spring pillar.

6. The operating mechanism of the circuit breaker according to claim 5, wherein a clamping slot which penetrates through the slot wall of the ring slot is provided at a bottom of the second notch in a releasing rotation direction of the trigger lever; a limiting portion for preventing the trigger lever from dropping along the axial direction is formed at the slot wall portion of the ring slot at the top of the clamping slot; and wherein the movable contact is capable of rotating inside a space defined by the first notch and the second notch relative to the contact support.

7. The operating mechanism of the circuit breaker according to claim 5, wherein an inclined introduction surface is provided at one end, facing to the fixing slot, at the top of the spring pillar; and wherein a supporting plate for supporting the trigger lever is formed by extending outwards from a position, where the second notch is located, at the bottom of the ring slot.

8. The operating mechanism of the circuit breaker according to claim 1, wherein the contact support further comprises a mechanical interlocking rotation shaft and a lock catch rotation shaft; the operating mechanism further comprises a transmission link, a mechanical interlocking device, a lock catch, and a releasing device matched with the lock catch to realize a releasing action of the circuit breaker; further wherein the mechanical interlocking device and the lock catch are pivotally provided on the mechanical interlocking rotation shaft and the lock catch rotation shaft of the contact support respectively; one end of the mechanical interlocking device is in hinged connection to the operating handle through the transmission link; the other end of the mechanical interlocking device is connected with a hasp of the lock catch.

9. The operating mechanism of the circuit breaker according to claim 8, wherein the releasing device comprises an electromagnetic releasing module which comprises a striker, the striker is in contact and fixed with a movable iron core of the electromagnetic releasing module under the extrusion of an acting spring, and the striker can be popped up to strike the lock catch, such that the mechanical interlocking device is separated from the hasp of the lock catch.

10. The operating mechanism of the circuit breaker according to claim 8, wherein the releasing device comprises a thermal overload releasing module, wherein the thermal overload releasing module comprises a bimetallic strip that is deformable according to the temperature change; further wherein a releasing link is provided on the lock catch; the bimetallic strip is connected with the releasing link, such that the mechanical interlocking device is separated from the hasp of the lock catch.

* * * * *